US012358034B2

(12) United States Patent
Rosenthal et al.

(10) Patent No.: US 12,358,034 B2
(45) Date of Patent: Jul. 15, 2025

(54) CASTING-ROLLING SYSTEM FOR BATCH AND CONTINUOUS OPERATION

(71) Applicant: SMS GROUP GMBH, Duesseldorf (DE)

(72) Inventors: Dieter Rosenthal, Niederfischbach (DE); Christoph Klein, Kreuztal (DE)

(73) Assignee: SMS GROUP GMBH, Duesseldorf (DE)

( * ) Notice: Subject to any disclaimer, the term of this patent is extended or adjusted under 35 U.S.C. 154(b) by 804 days.

(21) Appl. No.: 17/056,783

(22) PCT Filed: May 23, 2019

(86) PCT No.: PCT/EP2019/063324
§ 371 (c)(1),
(2) Date: Nov. 19, 2020

(87) PCT Pub. No.: WO2019/224305
PCT Pub. Date: Nov. 2, 2019

(65) Prior Publication Data

US 2021/0121924 A1 Apr. 29, 2021

(30) Foreign Application Priority Data

May 23, 2018 (DE) ..... 102018208122.0
May 21, 2019 (DE) ..... 102019207459.6

(51) Int. Cl.
*B21B 1/26* (2006.01)
*B22D 11/04* (2006.01)
(Continued)

(52) U.S. Cl.
CPC ..... *B21B 1/26* (2013.01); *B22D 11/0408* (2013.01); *B22D 11/05* (2013.01);
(Continued)

(58) Field of Classification Search
CPC ... B21B 1/26; B21B 2201/08; B21B 2201/10; B21B 1/463; B21B 2261/04; B22D 11/0408; C21D 9/56
See application file for complete search history.

(56) References Cited

FOREIGN PATENT DOCUMENTS

DE 102008020412 A1 * 2/2009 ..... B21B 1/46
DE 202011110781 U1 5/2016
(Continued)

*Primary Examiner* — Anthony M Liang
(74) *Attorney, Agent, or Firm* — Amster, Rothstein & Ebenstein LLP

(57) ABSTRACT

A method for producing an ultra-thin strip of less than 0.8 mm from cast steel in batch/continuous operation with a casting-rolling system. The method includes casting a thin slab having a casting thickness of 90-150 mm and width of at least 1000 mm at a casting speed of 7 m/min. The thin slab is heated/homogenized to a first temperature in a continuous furnace and subsequently rolled by at least seven final roll stands into an ultra-thin band. Neither the thin slab nor strip undergo inductive heating during production. The thin slab rolling steps include rough rolling the thin slab at the heated/homogenized first temperature by a roughing stand; heating/homogenizing the rough-rolled thin slab to a second temperature by a further continuous furnace; and finally rolling the rough-rolled thin slab at the second temperature to the ultra-thin strip by the final roll stands arranged downstream of the further continuous furnace.

8 Claims, 2 Drawing Sheets

Figure 1:
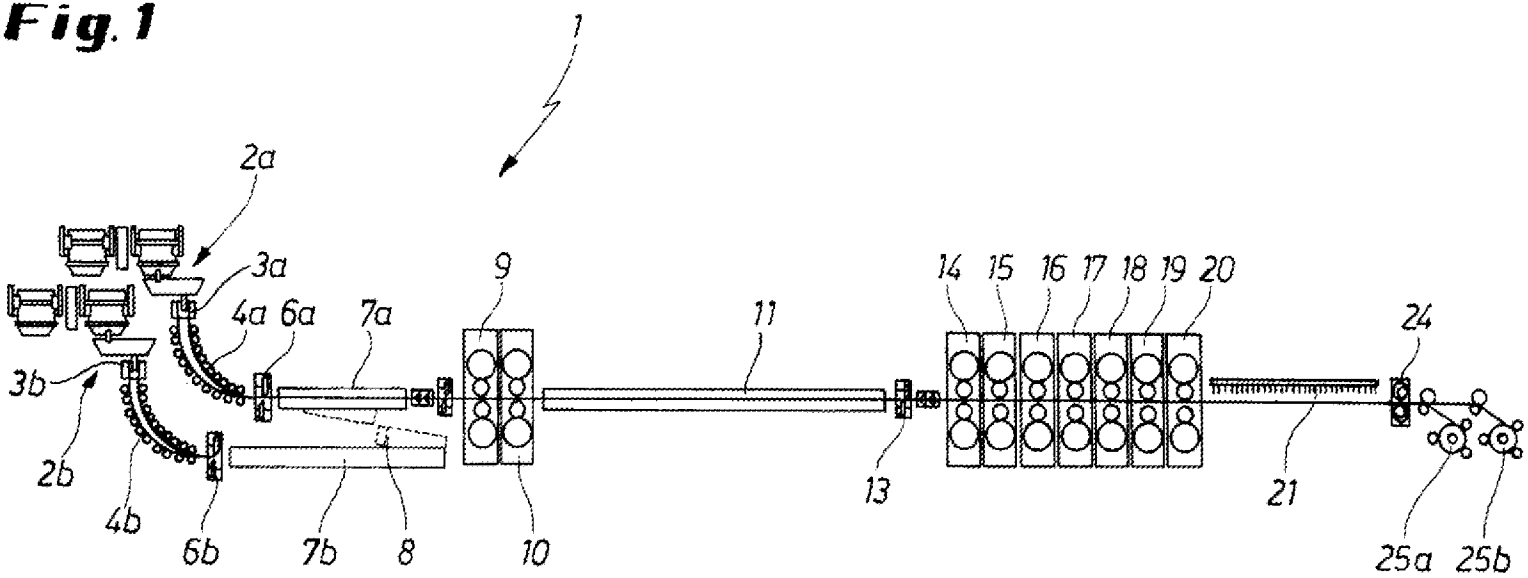

(51) Int. Cl.

| | |
|---|---|
| ***B22D 11/05*** | (2006.01) |
| ***B22D 11/12*** | (2006.01) |
| ***B22D 11/14*** | (2006.01) |
| ***C21D 1/28*** | (2006.01) |
| ***C21D 8/02*** | (2006.01) |
| ***C21D 9/56*** | (2006.01) |

(52) U.S. Cl.
CPC ..... *B22D 11/1213* (2013.01); *B22D 11/142* (2013.01); *C21D 1/28* (2013.01); *C21D 8/0205* (2013.01); *C21D 8/0226* (2013.01); *C21D 9/56* (2013.01)

(56) References Cited

FOREIGN PATENT DOCUMENTS

| | | | | | |
|---|---|---|---|---|---|
| DE | 102015216512 | A1 | | 3/2017 | |
| WO | WO-9513149 | A1 | * | 5/1995 | ..... B21B 1/466 |
| WO | WO-2016195172 | A1 | * | 12/2016 | ..... B21B 1/46 |

* cited by examiner

| Layout: 8-Stand Compact (endless mode) | | | | |
|---|---|---|---|---|
| | | 1.0 mm x 1200 mm | 1.3 mm x 1550 mm | „flow" mm x m/min |
| S315MC | 100 mm | 7.9 m/min | 9.1 m/min | 700 ~ 910 |
| | 110 mm | 7.2 m/min | 8.4 m/min | 790 ~ 925 |
| | | 1.2 mm x 1200 mm | 1.5 mm x 1550 mm | „flow" mm x m/min |
| HDT580X | 100 mm | 9.6 m/min | 11.5 m/min | 960 ~ 1150 |
| | 110 mm | 8.8 m/min | 10.7 m/min | 970 ~ 1180 |
| Layout: 8-Stand Compact (batch mode) | | | | |
| | | 1200 mm | 1550 mm | |
| S315MC | 100 mm | 2.30 mm | 2.80 mm | - |
| HDT580X | 100 mm | 2.75 mm | 3.50 mm | - |

*Final roll temperatures at the high casting speeds > 900°C (continuous mode)

CASTING-ROLLING SYSTEM FOR BATCH AND CONTINUOUS OPERATION

CROSS REFERENCE TO RELATED APPLICATIONS

This application is a national phase of PCT application No. PCT/EP2019/063324, filed May 23, 2019, which claims priority to DE patent application No. 102018208122.0, filed May 23, 2018, and DE patent application No. 102019207459.6, filed May 21, 2019, all of which are incorporated herein by reference thereto.

1. FIELD OF THE INVENTION

The invention relates to a casting-rolling system for producing a thin or ultra-thin strip, in particular hot strip, from a cast thin slab of steel in batch or continuous operation, comprising at least one casting plant for casting a thin slab, at least one continuous furnace arranged downstream of the at least one casting plant, and at least seven roll stands arranged downstream of the continuous furnace. The invention also relates to a method for producing a thin or ultra-thin strip, in particular hot strip, preferably having a thickness of 0.8 to 26 mm, from a cast thin slab made of steel in batch or continuous operation, preferably by means of the above mentioned casting-rolling system.

2. STATE OF THE ART

Casting-rolling systems for producing a thin or ultra-thin strip, in particular hot strip, from a cast thin slab made of steel are well known. In this case, cast thin slabs of different formats both in terms of thickness and width, usually with a thickness of up to 60 mm and a width of up to 2,000 mm, are cast in a continuous casting process and subsequently, using the casting heat, are directly hot rolled in a downstream rolling mill into thin or ultra-thin strips of at least 0.8 mm thickness.

It is of particular importance that the entire forming process up to the last rolling pass takes place above the transition temperature austenite→ferrite to ensure a microstructure within the thin or ultra-thin strip, which meets the requirements of hot-rolled strip.

While strip thicknesses of about 1.2 mm can be produced in batch operation without problems, with the casting strand being able to be separated after leaving the strand guide and then formed independently of the casting speed in the downstream roll stand, the rolling to strip thicknesses down to less than 1.2 mm, especially below 1.0 mm, is associated with difficulties with respect to the process control, since strips of such a thickness tend not to be able to be introduced safely into the roll gap which may lead to interruptions of the rolling process due to so-called cobbling.

Thin strips or ultra-thin strips with a thickness of <1.2 mm, in particular <1.0 mm, are therefore usually rolled in continuous operation, in which the casting strand is not separated after leaving the casting plant and prior to entering the rolling mill, which results in the casting speed having a direct influence on the downstream rolling process, in particular the maximally achievable rolling speed. However, since a final temperature above the transition temperature austenite→ferrite is a strictly required process variable, several adverse effects have to be addressed. On the one hand, the rolling speed, which is significantly reduced in the continuous operation compared to the batch mode, leads to lower forming speeds within the individual roll stands and thus to a lower energy input into the formed strip. On the other hand, in the continuous operation, the thin slab/strip to be rolled resides for a longer period in the casting-rolling system than in batch operation, combined with the unavoidable heat losses. In the continuous operation, it was therefore customary to reheat the cooled prior to entry into a series of roll stands of the rolling mill, in particular using induction heaters.

Many casting-rolling systems for producing a thin or ultra-thin strip, in particular hot strip, from a pre-cast thin slab made of steel are known to the skilled person, for example as so-called CSP or CEM plants. Common to all these systems is to have a casting plant, in which the primary cooling of the thin slab takes place, followed by a strand guide for the cast thin slab, in which the secondary cooling takes place. Downstream of the secondary cooling, a continuous furnace must be provided to reheat the pre-cast and cooled thin slab to the required rolling temperature, and in particular to homogenize the temperature within the thin slab over its cross-section and length. Such casting-rolling systems, which can be operated in a plurality of operating modes, for example in batch and continuous operation, previously required an inductive heating or other heating of the thin strip. However, casting-rolling systems of this type are very expensive and maintenance-intensive, both in terms of investment and operation.

3. OBJECT OF THE INVENTION

It was therefore an object of the invention to provide a casting-rolling system of the mentioned type, which is capable to roll a wide range of steel grades to thin and ultra-thin strips, especially hot strips, with smallest possible final thickness, and which can be operated cost-effectively. This object is achieved according to the invention with a casting-rolling system and method set forth both in the claims and in the following detailed description of the invention.

4. SUMMARY OF THE INVENTION

According to a first aspect of the invention, a casting rolling mill is provided for producing a thin or ultra-thin strip, particularly a hot strip, from a cast thin slab made of steel in batch or continuous operation. The casting plant is intended and configured to cast thin slabs having a minimum casting thickness of 90 mm and a maximum thickness of 150 mm, preferably from 90 mm to 140 mm and particularly preferably from 100 mm to 130 mm and with a casting width of at least 600 mm, in particular at least 1,000 mm. The casting plants provided for this purpose have casting molds which usually have adjustable longitudinal and/or broad sides to enable covering a largest possible casting spectrum. However, it is essential in the casting molds used according to the invention that the longitudinal sides are spaced apart from each other at a distance of at least 90 mm to 150 mm, preferably 90 mm to 140 mm, particularly preferably 100 mm to 130 mm, in order to be able to cast the desired thin slab formats.

According to the invention, a casting plant may be provided upstream of the one rolling mill, however it is also preferred if two parallel casting plants, optionally each provided with their own continuous furnace, are arranged upstream of a rolling mill. The reason for this is that the capacity of the rolling mill is significantly higher than the capacity of a single casting plant, since the casting speed of a single casting plant depends essentially on the casting format and the grade of steel to be cast. To optimally utilize the capacity of the rolling mill, two casting plants are often connected in parallel and together feed a rolling mill.

As mentioned above, a continuous furnace is arranged downstream of the casting plant, preferably downstream of each casting plant, to homogenize the temperature of the cast thin slab and optionally to heat the cast thin slab to the required rolling temperature. An essential feature of the invention is that no induction heating is provided for reheating the cast thin slab and/or the rolled strip during the entire forming process from the thin slab to the desired final thickness of the thin or ultrathin strip, in particular hot strip. This provides a Casting-rolling system which is capable of rolling cast thin slabs of comparatively large casting thickness by means of at least seven roll stands and rolling passes, preferably eight roll stands and corresponding rolling passes, without the need for inductive intermediate heating in both batch and continuous operation. As a result of the particularly large casting thickness, a system is provided that can produce a wide range of steel grades to a thickness of the thin or ultra-thin strip of 0.8 mm, especially in continuous operation, without the need of an inductive intermediate heating.

According to the invention, it is possible to reliably, flexibly and cost-effectively produce the steel product mix, such as commonly produced in casting-rolling systems, in particular LC (low carbon), MC (medium carbon), HC (high carbon), HSLA (high strength low alloy), DP (dual phase), other multiphase steels, API (the commonly used US standard for pipe grades), Si grades (silicon grades such as electrical steel sheets), AHSS (Advanced High Strength Steel) and Corten (weatherproof structural steels), with a maximum thickness of 25.4 mm and minimally up to 0.8 mm, up to an annual production capacity of 4.0 to 5.0 million tons per year (depending on the product mix).

Due to the casting thickness, the casting-rolling system according to the invention is capable of producing thin or ultra-thin steel strips in the continuous mode even from those steel grades that require a low casting speed, which in particular applies to the above-mentioned high carbon grades, because the mass flow from the casting plant, calculated as the product of casting speed (m/min.) and casting thickness (mm), is usually above the threshold set for continuous operation.

In certain embodiments of the Casting-rolling system according to the invention, for example in a rolling mill with seven or eight consecutive roll stands without intermediate continuous furnace, such a threshold is for example 650 mm×m/min., however, in a plant configuration with, for example, two roughing stands, a second continuous furnace arranged downstream of the roughing stand and five, six or seven final roll stands arranged downstream of the continuous furnace, the threshold may for example be 350 mm×m/min., preferably 500 mm×m/min.

An essential factor in determining the operating mode of the casting-rolling system is usually whether the final rolling temperature is above the transformation temperature austenite→ferrite, so that a hot strip microstructure can be made according to customer requirements. If the mass flow from the casting plant does not meet this requirement, or if there is no possibility of re-heating by means of a continuous furnace, rolling must take place in batch mode, otherwise the continuous operation can be carried out regularly, which in particular ensures production of very small thin strip thicknesses below 1.2 mm, in particular below 1.0 mm.

The casting thicknesses according to the invention of 90 mm to 150 mm, preferably 90 mm to 130 mm, in particular 100 mm to 130 mm, are preferably cast into thin slabs at casting speeds of up to 7 m/min. and are then formed in a compact rolling mill to thin strip or ultra-thin strip. The working roll diameter of the first roll stands, preferably the first two roll stands of the rolling mill, is preferably more than 1,000 mm, particularly preferably 1,050 mm, wherein the first roll stands, preferably the first two roll stands, are capable of exerting a maximal rolling force of 35 mN/m at a maximal rolling torque of 4,000 kNm.

In a preferred embodiment of the invention, a shear for cutting the leading start of the strip and optionally the end of the strip are preferably arranged between the roll stands after the second and before the third of the at least seven, preferably eight, roll stands. As a result, the start of the strip, and possibly also the end of the strip, which may deform in a tongue-like manner, can be straightened in particular during the first rolling passes, which enables a more reliable process control and a more reliable threading of the start of the strip into the further roll stands.

According to a further preferred embodiment of the invention, the roll stands of the rolling mills arranged downstream of the casting plant or the casting plants, can be divided into one or two roughing stands, in particular one or two roughing stands with particularly high torque of at least 1,800 kNm, preferably at least 2,000 kNm, more preferably between 2,000 kNm and 3,400 kNm, as well as at least five, preferably six or seven, finishing roll stands, preferably finishing rolling mills with a torque lower than the roughing stands of at least 100 kNm, preferably between 100 kNm and 1,400 kNm. In this context, it is particularly preferred when a further continuous furnace is arranged between the roughing stands and the finishing stands, in which further continuous furnace the pre-rolled strip for the final rolling is warmed up to the desired temperature and/or homogenized. Furthermore, an inductive intermediate heating can be completely dispensed with, since the mass flow is enabled for the production of thin or ultra-thin strip in continuous operation over a large product mix up to the smallest thicknesses even in steel grades that require a particularly low casting speed. Restrictions exist, if at all, only in the production of ultra-thin strips with a thickness <1.2 mm for high-strength grades with a particularly low casting speed.

In a further preferred embodiment of the invention, the rolling gap of the last final roll stand can be adjusted to a final thickness of the thin strip to be produced from 0.8 mm to 26 mm, preferably from 1.0 mm to 25.4 mm. This ensures that the Casting-rolling system according to the invention enables safe and cost-effective manufacture the product spectrum required by the market.

In a further preferred embodiment of the invention, the casting-rolling system according to the invention has a cooling line downstream of the last roll stand, shears, preferably flying shears, and at least one reel, so that the rolled hot strip can be securely cooled and wound into coils with predefined weight.

When the casting-rolling system according to the invention has two casting plants arranged parallel to one another upstream of the rolling mill, a device for transferring a thin-slab from the second casting plant is preferably provided in or behind the continuous furnace downstream of the first casting plant. Such a device may for example be a mobile furnace segment, however it is preferred to use two stationary furnace segments both in the continuous furnace downstream of the first casting plant and in the continuous furnace downstream of the second casting plant, wherein the stationary furnace segments are formed so as to have roller table segments that can be pivoted toward each other, and which can be pivoted from a rest position into a transfer position in alignment with each other to thereby ensure the transfer of a thin slab from the continuous furnace downstream of the second casting plant to the continuous furnace downstream of the first casting plant and optionally also back.

The casting-rolling system according to the invention is intended and configured to produce a large spectrum of thin slabs with different thicknesses and different widths. Preferably, the casting molds provided in the respective casting plants have adjustable broadsides, that may assume a distance to each other of at least 900 mm, preferably at least 1,000 mm to 2,000 mm, more preferably 1,000 mm to 1,800 mm. As a result, a casting plant is created with particularly simple means, which is capable of producing the desired spectrum of thin slab widths without having to exchange one casting mold for another.

According to the second aspect of the invention, a method is provided of producing a thin or ultra-thin strip, particularly hot strip, from a cast thin slab made of steel in batch or continuous operation with a casting-rolling system, particularly preferably a casting rolling system according to the first aspect of the invention. The casting-rolling system comprises at least one casting plant and at least seven, preferably eight, rolling mills arranged downstream of the casting plant. The method according to the invention comprises the steps of casting at least one thin slab having a casting thickness of 90 mm to 150 mm, preferably from 90 mm to 140 mm, particularly preferably from 100 mm to 130 mm, with a casting width of at least 600 mm, preferably at least 1000 mm, heating and/or homogenizing the temperature of the thin slab in a continuous furnace and rolling the heated and/or homogenized thin slab by means of at least seven, preferably eight roll stands, into a thin or ultrathin strip, preferably hot strip, wherein the thin slab and/or the strip undergoes no inductive heating during the process of producing the thin or ultra-thin strip.

The technical effects which can be brought about by the second aspect of the invention correspond to those described above in relation to the first aspect of the invention.

Preferably, operation of the casting-rolling system can be switched between batch mode and continuous mode depending on the mass flow of the casting plant calculated as the product of the casting thickness (in mm) and the casting speed (in m/min.). Particularly preferably, the continuous operation is set regularly when a mass flow threshold is exceeded, wherein this mass flow threshold is particularly preferably set at 350 mm×m/min, preferably 500 mm×m/min, when the thin slab is formed to a thin or ultra-thin strip by means of one or two roughing stands and five to seven final roll stands with an intermediate continuous furnace. On the other hand, when the forming of the cast thin slab into a thin or ultra-thin strip is carried out with at least seven, preferably eight, roll stands without a continuous furnace there between, a threshold for the mass flow of 650 mm/min and min. is preferred to switch between the batch mode and the continuous mode.

5. BRIEF DESCRIPTION OF THE FIGURES

The invention will be explained in more detail below with reference to the FIGS. which show preferred embodiments of the invention.

It is shown in

FIG. 1 a schematic view of an extended system configuration according to the invention.

Figure 2:
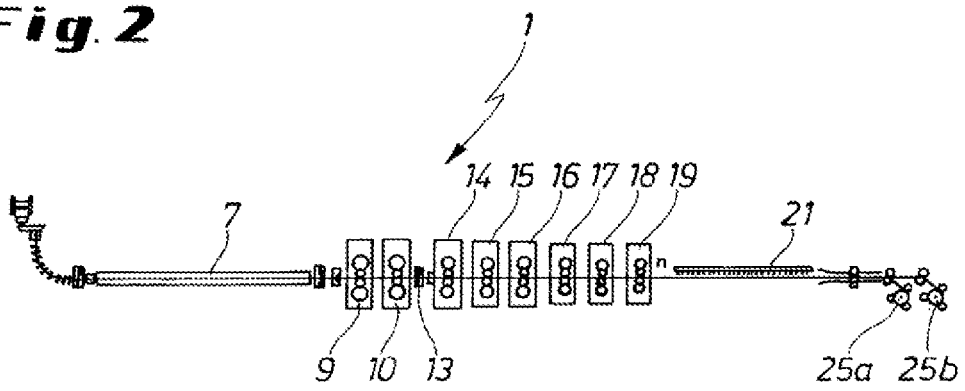

FIG. 2 a schematic illustration of an embodiment of the inventive casting-rolling system with eight roll stands arranged one behind the other and an example calculation for the operation of the inventive casting-rolling system.

DETAILED DESCRIPTION OF PREFERRED EMBODIMENTS

FIG. 2 shows a schematic illustration of an embodiment of the inventive casting-rolling system and a table with results of exemplary experiments for producing thin strips from different steel grades with a casting-rolling system 1 according to the invention, here with a system layout having a casting plant, a downstream continuous furnace 7 and eight final roll stands 9, 10, 14-19, followed by a cooling section 21 and two reels 25*a*, 25*b*. After the first two stands 9, 10, shears 13 are arranged to cut off the strip head after exit from the second roll stand 10 and to straighten the strip on the head side.

An S315MC grade steel was cast into a thin slab having a thickness of 100 mm or 110 mm and width of 1200 mm, at a withdrawal rate of 7.9 m/min. or 7.2 m/min. This thin slab was rolled in continuous operation into a thin strip with a thickness of 1.0 mm and width of 1,200 mm. In a further experiment, the same steel grade was cast at a casting speed of 9.1 m/min. or 8.4 m/min. in continuous operation to a thin slab having a thickness of 100 mm or 110 mm and a width of 1,550 mm, and was rolled, also in continuous operation, to a thin strip having a thickness of 1.3 and a width of 1,550 mm. The mass flow ("Flow") was 700 to about 925 mm×m/min, thus above the threshold for using continuous operation. The final rolling temperatures were above 900° C., thus significantly above the transformation temperature austenite→ferrite.

In another series of tests, steel grade HDT580X was cast into thin slabs with a thickness of 100 mm or 110 mm and a width of 1,200 mm at casting speeds of 9.6 m/min. or 8.8 m/min. Forming in the continuous operation resulted in a thin strip with a thickness of 1.2 mm and a width of 1,200 mm. In a further pair of experiments, the same steel was cast into a thin slab with a thickness of 100 mm or 110 mm and a width of 1,550 mm at a casting speed of 11.5 m/min. or 10.7 m/min. The mass flow ("Flow") was 960 to 1,180 mm×m/min., thus also clearly above the threshold for continuous operation, the final rolling temperatures for the test series with the steel grade HDT580X were above 900° C.

With the same system layout, in a further series of tests, grade S315MC steel was cast into a thin slab with a thickness of 100 mm and a width of 1200 mm. From the thin slab, a thin strip of 2.30 mm thickness was rolled in batch operation. A thin slab of S315MC grade steel was also cast with a thickness of 100 mm and a width of 1,550 mm, and finally rolled in batch operation to a thin strip with a thickness of 2.80 mm.

In a further series of tests, HDT580X grade steel was cast into a thin slab with a thickness of 100 mm and a width of 1,200 mm or 1,550 mm, and finally rolled into a thin strip with a thickness of 2.75 mm or 3.50 mm in batch operation. Also in batch mode, the final rolling temperatures were above the austenite→ferrite transition temperature to obtain a hot rolled microstructure in the final rolled strip.

FIG. 1 shows a casting-rolling system 1 in a further system layout according to the invention, wherein the casting-rolling system 1 has two casting plants 2*a*, 2*b* with respective casting molds 3*a*, 3*b*. After exit from the strand guide 4*a*, 4*b*, the solidified strand is cut by means of shears 6*a*, 6*b*, if a batch operation is to be performed on the casting-rolling system 1, and then enters a continuous furnace 7*a*, 7*b*. Between the continuous furnaces 7*a*, 7*b*, a device 8 for transferring a slab (not shown) from the continuous furnace 7*b* into the continuous furnace 7*a* is provided. After exit from the continuous furnace 7*a*, the slab enters a pair of roughing stands 9, 10 and is rolled in these roughing stands 9, 10 to a strip, which then enters a further continuous furnace 11 where it is reheated. After exit from the further continuous furnace 11, the pre-rolled strip can be straightened on the head side by means of shears 13, to then enter a series of final roll stands 14 to 20. Upon exiting the last roll stand 20, the strip has the desired final thickness and the desired final rolling temperature, whereupon the rolled strip is then cooled in the cooling section 21 to the temperature required for reeling. Downstream of the cooling section 21, a high speed shear 24 is provided which is used when thin strip is rolled in continuous mode and in this case has to be cut to the length of the reel without interrupting the casting-rolling process. The rolled and optionally cut thin strip can then be alternatingly wound up on two reels 25*a*, 25*b* on the fly.

LIST OF REFERENCE NUMBERS

1 cast rolling mill
2*a*, 2*b* casting plants
3*a*, 3*b* casting molds
4*a*, 4*b* strand guide
6*a*, 6*b* shear
7*a*, 7*b* continuous furnace
8 device for transferring a slab
9 roughing stand
10 roughing stand
11 continuous furnace
13 shears
14-20 finishing roll stands
21 cooling section
23 cooling section
24 high-speed shears
25*a*, 25*b* reel

The invention claimed is:

1. A method for producing an ultra-thin strip of or less than 0.8 millimeter (mm) from cast steel in a batch mode or a continuous mode of operation with a casting-rolling system which includes at least one casting plant and at least seven final roll stands, the method comprising the steps of:

casting a thin slab having a slab casting thickness of 90 mm to 150 mm and a casting width of at least 1200 mm at a casting speed of 7 m/min;

heating and/or homogenizing the thin slab to a first temperature in a continuous furnace; and rolling the thin slab by the at least seven final roll stands, wherein the thin slab undergoes no inductive heating during production of the ultra-thin strip;

wherein the step of rolling the thin slab includes:

rough rolling the thin slab at the heated and/or homogenized first temperature by at least one roughing roll stand;

heating and/or homogenizing the rough-rolled thin slab to a second temperature by a further continuous furnace, the first and second temperatures being greater than an austenite-to-ferrite transition temperature; and finally rolling the rough-rolled thin slab at the second temperature, to the ultra-thin strip with a thickness of or less than 0.8 mm by the at least seven final roll stands, which are arranged downstream of the further continuous furnace.

2. The method according to claim 1, wherein a leading portion or edge of the thin slab is cut off by a cutter positioned between a last of the at least one roughing roll stand and a first of the at least seven final roll stands.

3. The method according to claim 1, wherein the casting-rolling system is switchable between the batch mode and the continuous mode depending on a mass flow of the at least one casting plant which is calculated as a product of the slab casting thickness and the casting speed.

4. The method according to claim 3, wherein the casting-rolling system is operable in the continuous mode of operation above a threshold value for the mass flow of 350 mm*m/min.

5. The method according to claim 1, wherein an annual output of the casting-rolling system is between 4.0 and 5.0 million tons.

6. The method according to claim 1, wherein casting-rolling system produces the ultra-thin strip of LC, MC, HC, HSLA, DP, API, Si grades, AHSS and Corten steels.

7. The method according to claim 1, wherein a final rolling temperature in a last roll stand of the at least seven final roll stands is set above 820° C.

8. The method according to claim 1, wherein a trailing portion or edge of the thin slab is cut off by a cutter positioned between a last of the at least one roughing roll stand and a first of the at least seven final roll stands.

* * * * *